US005803647A

United States Patent [19]

Hughes

[11] Patent Number: 5,803,647

[45] Date of Patent: Sep. 8, 1998

[54] HANDRAIL CONNECTION DEVICE

[76] Inventor: Ceiriog Hughes, 8447 Edwood Rd., Pittsburgh, Pa. 15237

[21] Appl. No.: 791,593

[22] Filed: Jan. 31, 1997

Related U.S. Application Data

[60] Provisional application No. 60/010,866 Jan. 31, 1996.

[51] Int. Cl.[6] ..... B25G 3/00

[52] U.S. Cl. ..... 403/306; 403/286; 403/291; 403/220; 256/65

[58] Field of Search ..... 256/65, 67, 59, 256/DIG. 1; 403/306, 301, 300, 305, 286, 291, 229, 220

[56] References Cited

U.S. PATENT DOCUMENTS

| | | | |
|---|---|---|---|
| 198,275 | 12/1877 | Chase | 256/DIG. 1 |
| 484,061 | 10/1892 | Spillinger | 256/DIG. 1 |
| 565,160 | 8/1896 | Ewart | 256/DIG. 1 |
| 606,506 | 6/1898 | Bowen | 256/DIG. 1 |
| 1,469,304 | 10/1923 | Hughes | 403/305 |
| 2,080,627 | 5/1937 | Morgan | 403/220 X |
| 2,348,071 | 5/1944 | Johnstone | 403/305 |
| 2,467,752 | 4/1949 | Howe | 403/229 X |
| 3,197,552 | 7/1965 | Flair | 403/220 X |
| 3,437,059 | 4/1969 | Stonier et al. | 403/220 X |
| 3,995,897 | 12/1976 | Paskert | 403/300 X |
| 4,477,059 | 10/1984 | Willis | 256/59 X |
| 4,562,914 | 1/1986 | Boltrek . | |
| 4,610,611 | 9/1986 | Blain | 403/291 X |
| 4,869,552 | 9/1989 | Tolleson et al. | 403/220 X |
| 5,209,138 | 5/1993 | Shu | 403/229 X |
| 5,433,549 | 7/1995 | McGaffigan | 403/220 X |
| 5,615,968 | 4/1997 | Verenski et al. | 256/65 X |

*Primary Examiner*—Kenneth J. Dorner
*Assistant Examiner*—William L. Miller
*Attorney, Agent, or Firm*—Webb Ziesenheim Bruening Logsdon Orkin & Hanson, P.C.

[57] ABSTRACT

A handrail connector for a pair of longitudinally spaced apart handrails having ends defining openings, the connector including a flexible bar having ends sized to be fitted within opposing openings of the handrails and being adapted to be retained with the openings upon movement of either of the handrails. The flexible bar includes a stop secured at its center and two biasing members placed on opposite sides of the stop. The biasing members provide a pushing force between the stop and each of the handrail ends to center the handrail connector between the handrail ends.

14 Claims, 3 Drawing Sheets

HANDRAIL CONNECTION DEVICE

CROSS REFERENCE TO RELATED APPLICATION

This application claims the benefit of earlier filed U.S. Provisional patent application Ser. No. 60/010,866, filed Jan. 31, 1996.

BACKGROUND OF THE INVENTION

1. Field of the Invention

The present invention relates to an apparatus for connecting handrails, and more particularly, to an apparatus for connecting handrails that are part of a longwall mining system.

2. Background Art

Longwall mining systems are used in underground tunnels. Typically, a longwall mining system is used to mine coal and includes a shearing machine that is adapted to shear off coal from a face of a tunnel wall and a conveyor to transport the coal out of the tunnel. In longwall mining, a coal seam is mined by advancing the shearing machine across the face of an exposed rock formation. A moveable wall opposing the mined face and a moveable ceiling above the tunnel space advance in the direction of the mined face as coal is sheared off the face. Cables carrying power and control supply lines needed to operate the mining equipment are located between the movable back wall and the shearing machine.

FIGS. 1 and 2 show a mining system of the prior art within a tunnel 2 formed by a mined face 4, moveable back wall 6, a moveable ceiling 8 and a floor 10. A shearing machine 12 adapted to mine the face 4 is connected to a conveyor 14 which removes coal mined from the face 4. Adjacent the shearing machine 12 is a frame 16 supporting a spill plate 18 which retains mined coal in the area of the conveyor 14. A handrail 20 is connected via an L-shaped wall 22 to the spill plate 18. The L-shaped wall 22 supports a cable handling system 24. The handrail 20 on the L-shaped wall 22 is typically two to three feet off the floor 10. The L-shaped wall 22 separates miners from the shearing machine 12 for safety reasons. The handrail 20, typically a round tube, provides a surface for the miners to grip when working near the shearing machine 12.

The spill plate 18 includes a plurality of spill plate sections 26 interconnected by a plurality of spill plate joints 28. Likewise, the handrail 20 which typically extends 600 to 1,000 feet long, includes a plurality of steel handrail sections 30 aligned end-to-end and interconnected by a plurality of handrail joints 32. The handrail sections 30 typically are steel pipes about five feet in length and each terminating in a pair of handrail ends 34 and 34' spaced about five inches apart from the opposing respective handrail ends 34 and 34' of another handrail section 30. The handrail joint 32 conventionally is a flexible plastic rod inserted into openings 36 and 36' in opposing handrail ends 34 and 34'.

The flexible joints 28 and 32 allow the spill plate sections 26 and the handrail sections 30 to be moved toward the mined face 4 along with the movable sections of the ceiling 8 and the back wall 6 after the shearing machine 12 passes by each spill plate section 26 and handrail section 30. Because the floor 10 is not perfectly smooth, the flexible joints 28 and 32 and the individual spill plate sections 26 and the handrail sections 30 allow the spill plate and the handrail to articulate in response to rises and falls in the tunnel floor 10.

During movement of the handrail sections 30 and spill plate sections 26 in the direction of the mined face 4 or in the direction of their longitudinal axes, the handrail joint 32 formed as a plastic rod has a tendency to slip out of the handrail ends 34 and 34'. Slippage of the handrail joint 32 out of the handrail ends 34 and 34' also occurs when the handrail 20 is installed over an uneven floor 10 causing the handrail ends 34 and 34' to be misaligned. Misalignment of the handrail ends 34 and 34' and/or absence of the handrail joint 32 creates a safety hazard. Specifically, misaligned opposing handrail ends 34 and 34' can pinch a miner's hand. The handrail joint 32 is also subject to damage when it slips out of the handrail end 34 or 34' when the resulting free end of the handrail joint 32 becomes jammed against the handrail end 34 or 34' it slipped out from.

It is an object of the present invention to provide an apparatus that retains a flexible joint between the handrail ends thereby protecting miners from injury and reducing the possibility of damage to the joint.

SUMMARY OF THE INVENTION

The present invention is a handrail connection device used to connect and align handrails associated with movable longwall mining equipment while protecting miners from injury and reducing the potential for damage to the handrails. In particular, the handrail connection device includes a connector for longitudinally spaced apart handrails having a pair of opposing ends each defining an opening, the connector having a flexible member having a pair of ends sized to be fitted within the opposing openings and being adapted to be retained with the handrail openings and a means for centering the flexible member between the handrails. The means for centering includes a stop mounted on the flexible member between the flexible member ends and a pair of biasing members. Each of the biasing members extend between the stop and one of the handrail ends whereby the biasing members urge the stop to be centered between the handrail openings. The stop defines an aperture through which the flexible member extends, the stop having a pair of coaxial holes and wherein the flexible member defines a bore coaxial with the pair of coaxial holes. A fastener is secured within the pair of coaxial holes and the bore to mount the stop onto the flexible member. A pair of washers through which the flexible member extends are each disposed between one of the biasing members and one of the handrail ends. The flexible member preferably includes a polyurethane bar and the biasing member includes a spring surrounding the bar.

The flexible member includes a pair of annular shoulders defining a groove and the stop includes a tab extending radially into the aperture, the tab being received within the groove. A slot defined in the flexible member extends from one end of the flexible member and opens into the groove, the tab being positioned between the shoulders.

The present invention further includes a sectional handrail having a plurality of longitudinally spaced apart handrail sections, each section having an end defining an opening opposing an opening in another of the handrail sections. Either of two ends of a flexible member are fitted within one of the opposing openings and are adapted to be retained within the openings. A means for centering the flexible member is disposed between the opposing ends and is described above.

The present invention also includes a method of installing a handrail connector between a pair of first and second longitudinally spaced apart handrails having a pair of opposing ends each defining an opening, the method having the steps of flexing a flexible member, the flexible member having (1) a stop mounted between two ends of the flexible member and (2) first and second biasing members each disposed between one of the ends and the stop; inserting one end of the flexible member into the opening of the first handrail; urging the stop towards the first handrail whereby the first biasing member is compressed; fitting the other end of the flexible member into the opening of the second handrail; and releasing the flexible member whereby the first biasing member expands and the second biasing member compresses such that the flexible member is centered between the handrail openings and each end of the flexible member is retained within a respective one of the handrail openings.

DESCRIPTION OF THE PREFERRED EMBODIMENT

Figure 1:
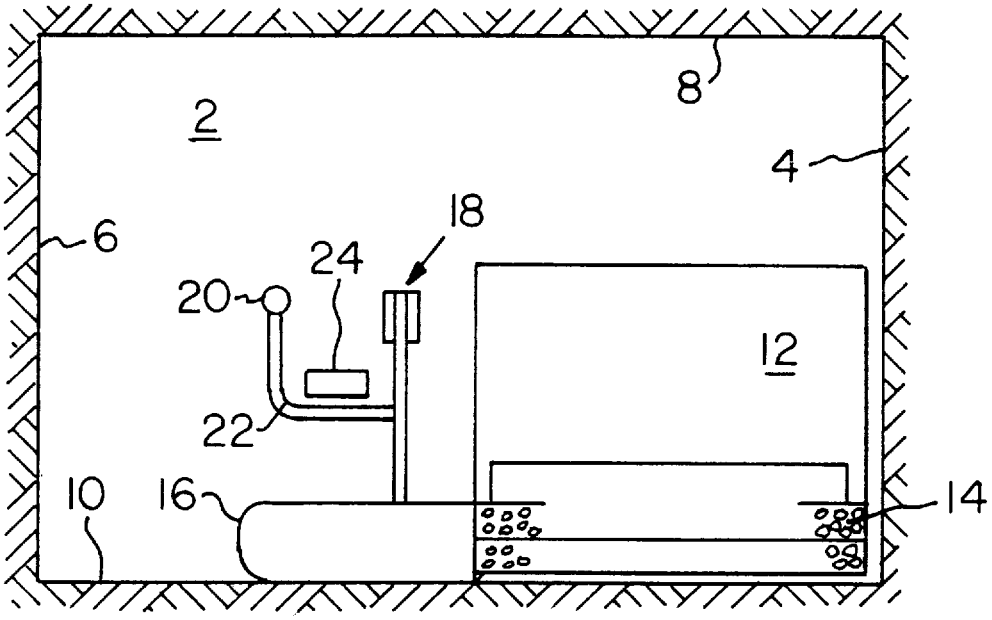
FIG. 1 PRIOR ART
FIG. 1 is a partial cross sectional view of a longwall mining system of the prior art.
Figure 2:
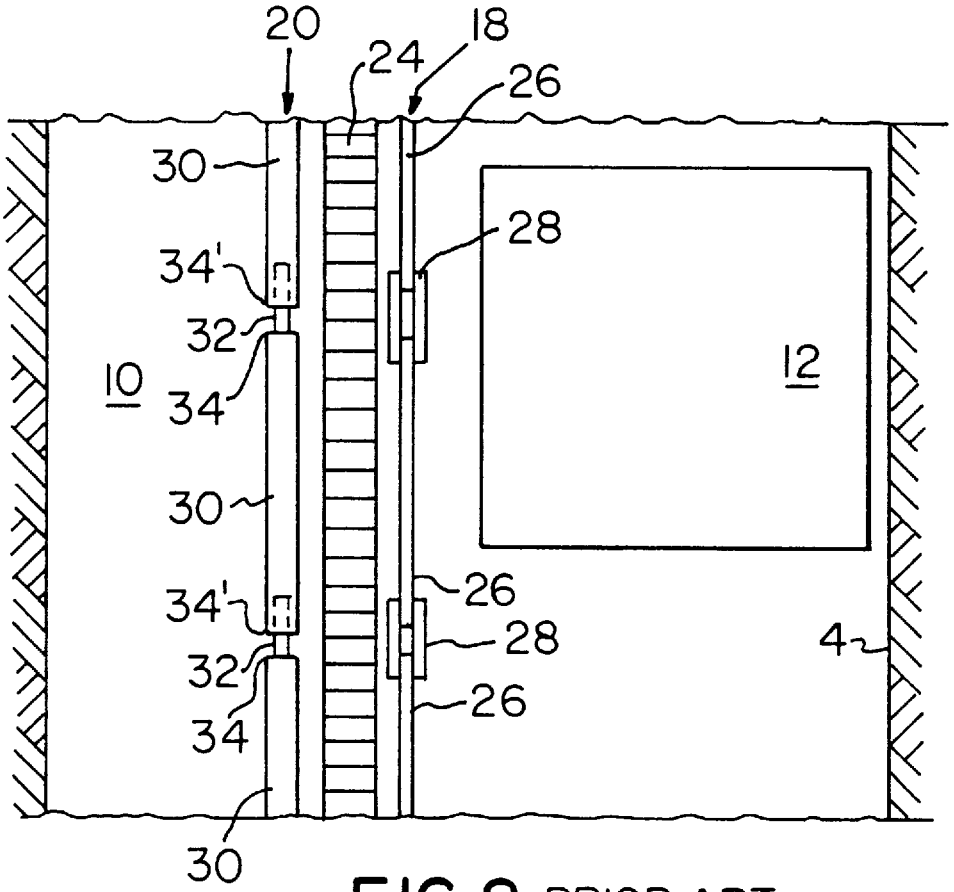
FIG. 2 PRIOR ART
FIG. 2 is a plan view of the longwall mining system shown in FIG. 1.
Figure 3:
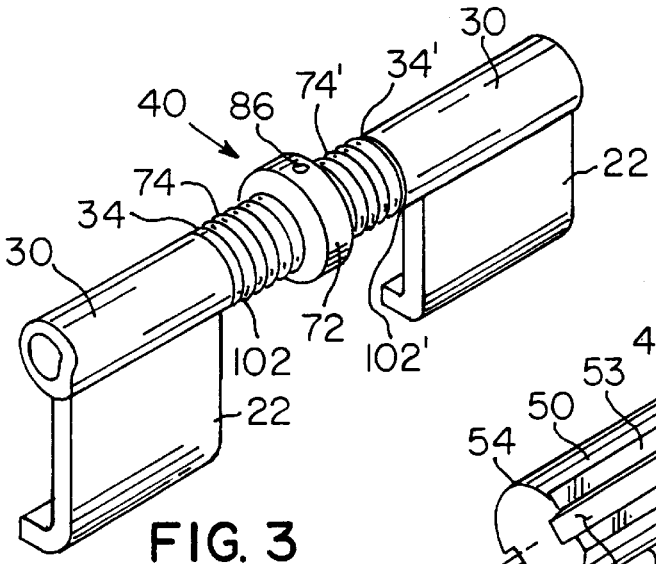
FIG. 3 is a top perspective view of a handrail connection device connecting two handrails made in accordance with the present invention.
Figure 4:
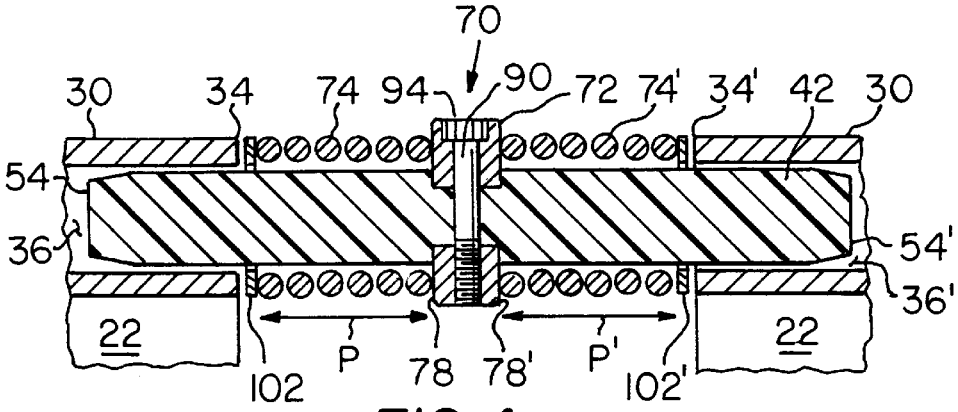
FIG. 4 is a cross-sectional elevation view of the handrail connecting device connecting two handrails as shown in FIG. 3.

FIGS. 3 and 4 depict a handrail connection device 40 of the present invention assembled and inserted between a pair of handrail ends 34 and 34' of a handrail 20.

Figure 7:
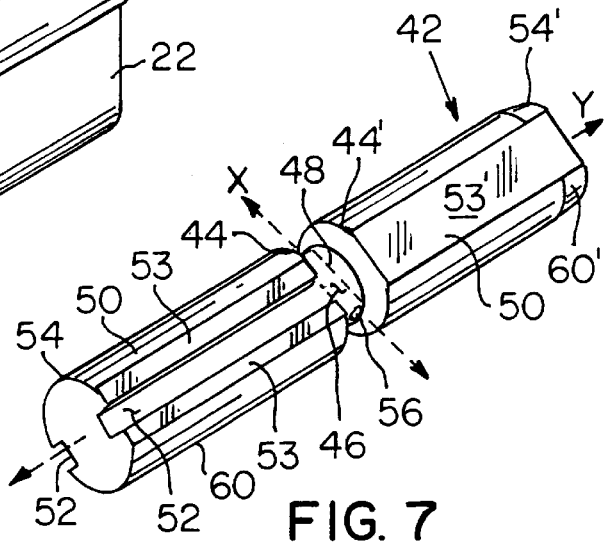
FIG. 7 is a top perspective view of the flexible member shown in FIG. 5.
Figure 5:
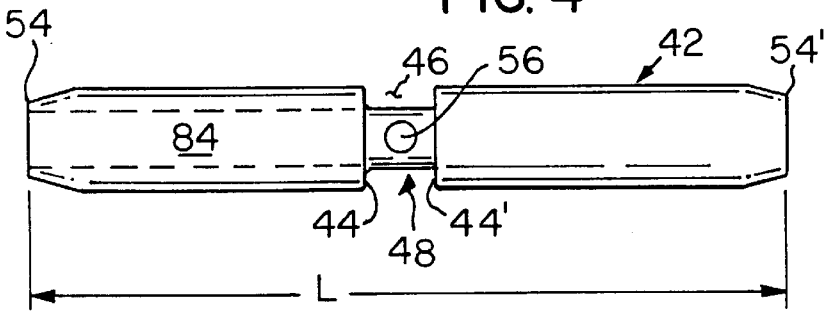
FIG. 5 is a side elevation view of a flexible member shown in FIG. 4.
Figure 6:
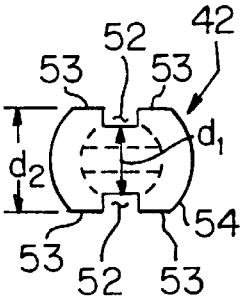
FIG. 6 is a front elevation view of the flexible member shown in FIG. 5.
Figure 8:
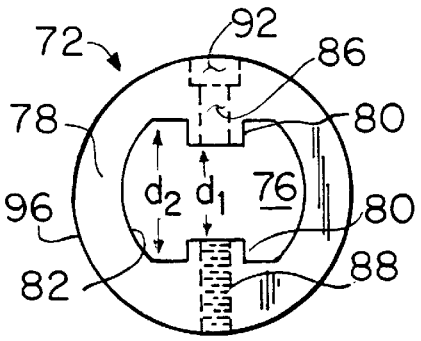
FIG. 8 is a side elevation view of a stop shown in FIG. 3.
Figure 9:
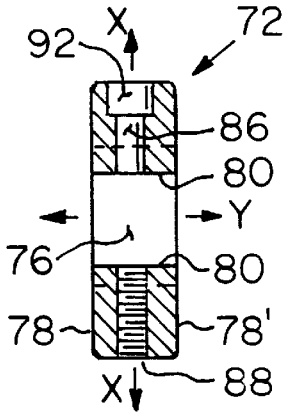
FIG. 9 is a cross-sectional view of the stop shown in FIG. 8.

The handrail connection device 40 includes a flexible member or bar 42 preferably formed in a solid cylindrical shape from polyurethane or other flexible material such as rubber. As depicted in FIGS. 5–7, a pair of spaced apart annular shoulders 44 and 44' of the bar 42 defining an annular groove 46 at a center 48 of the bar 42, the reduced diameter $d_1$ of the bar 42 in the groove 46 being less than the diameter $d_2$ of a main portion 50 of the bar 42. Preferably, $d_1$ is about one inch and $d_2$ is about 1½ inches. A pair of keyway slots 52 are defined in the bar 42 diametrically opposed from each other between a first end 54 and opening into the groove 46 such that the diameter of the bar 42 within the slots 52 is equal to the reduced diameter $d_1$ of the bar 42 in the groove 46.

The bar 42 defines a bore 56 within the groove 46 defined at the center 48 of the bar's length along an axis "X" passing through the bar 42 which is perpendicular to a longitudinal axis "Y" of the bar 42 and perpendicular to a plane defined by the longitudinal axes of the slots 52. A first end 54 and a second end 54' of the bar 42 are fittable within the openings 36 and 36' of the handrail ends 34 and 34' and preferably have outer shapes that correspond to the shapes of the openings 36 and 36' of the respective handrail ends 34 and 34'. Flat portions 53 are disposed on the main portion 50 adjacent the slots 52. Flat portions 53' are disposed on the main portion 50 between the annular shoulder 44' and the second end 54' of the bar 42. Preferably, the handrail ends 34 and 34' are cylindrical tubes and the bar first and second ends 54 and 54' are tapered as shown at 60 and 60' to ease insertion of the first and second ends 54 and 54' into the respective openings 36 and 36'.

As detailed in FIG. 4, a means for centering 70 the bar 42, including a stop 72 within the groove 46 and a pair of springs 74 and 74' on either side of the groove 46, is provided on the bar 42. The stop 72 defines an aperture 76 with two opposing sides 78 and 78'. A pair of diametrically opposed tabs 80 extend from an inner surface 82 of the stop 72. The inner surface 82 of the stop 72 is sized to slidably fit over the outer surface 84 of the bar 42 and within the groove 46 of the bar 42. The tabs 80 are sized to slidably fit within the slots 52 of the bar 42. One side 78 of the stop 72 is preferably painted with reflective green paint and the other side 78' of the stop 72 is preferably painted with reflective red paint to promote visibility of the handrail connection device 40 so that misaligned or missing parts can be readily noticed. A hole 86 and a tapped hole 88 are coaxially defined in the stop 72 along the axis "X" which passes through the stop 72 and the bore 56 and is perpendicular to the axis "Y" of the bar 42.

A threaded fastener 90 passes through the hole 86 and the bore 56 and screws into the tapped hole 88 in order to secure the stop 72 to the bar 42. The hole 86 preferably includes a counter-sunk bore 92 having a diameter large enough to receive the head 94 of the fastener 90 so that the head 94 is flush with an outer surface 96 of the stop 72. The fastener 90 preferably has an allen head 94, but can have any type of head 94 that allows the fastener 90 to be secured flush with the stop outer surface 96.

As depicted in FIGS. 3 and 4, each of the first and second ends 54 and 54' of the bar 42 receives one of a pair of biasing members or springs 100 and 100'. A first washer 102 optionally is disposed around the bar 42 between the first end 54 and the spring 100. A second washer 102' is disposed around the bar 42 between the second end 54' and the spring 100'. The springs 100 and 100' abut against opposite sides 78 and 78' of the stop 72 and are adapted to provide a pushing force in the direction of arrows P and P' between the stop 72 and each of the respective handrail ends 34 and 34'. The pushing forces P and P' aid in centering the handrail connection device 40 between the handrail ends 34 and 34'. The springs 100 and 100' also may be colored in a reflective color.

Figure 10A:
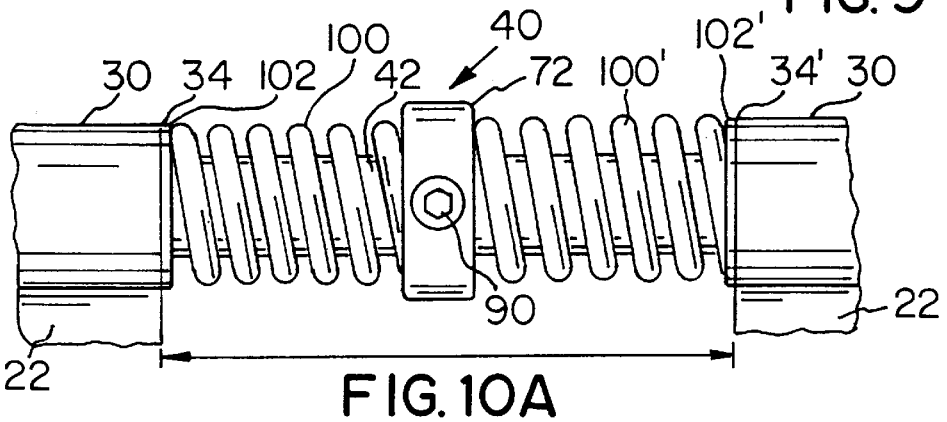
FIG. 10*a* is a side elevation view of the handrail connector shown in FIG. 3 with springs in a normal state.
Figure 10B:
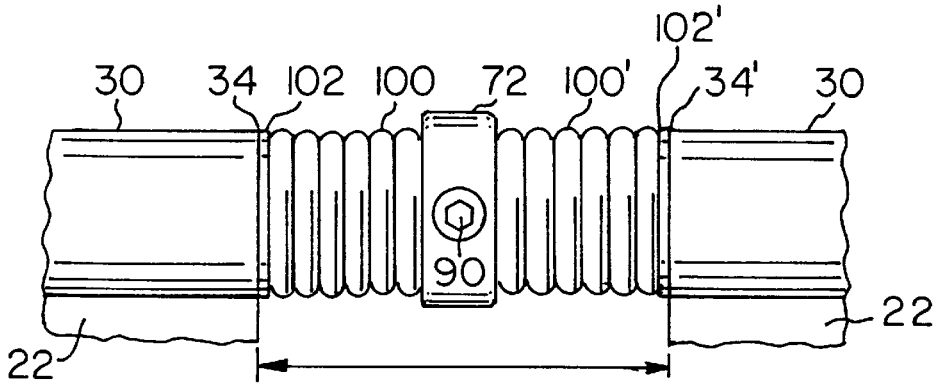
FIG. 10*b* is a side elevation view of the handrail connector shown in FIG. 10*a* with springs in a compressed state.
Figure 10C:
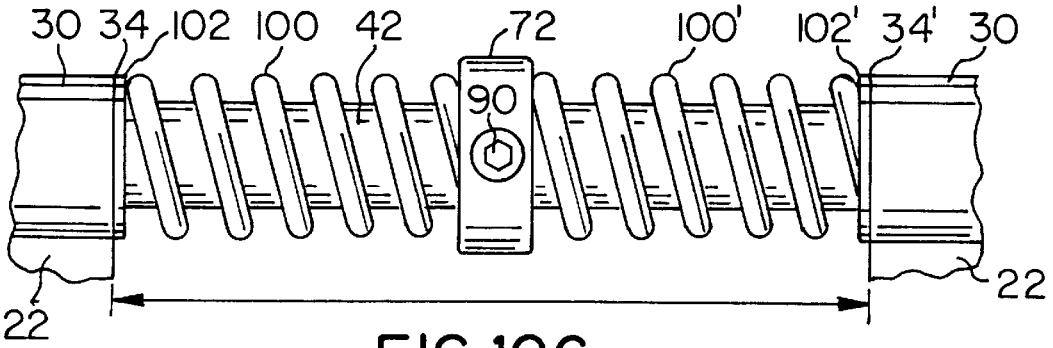
FIG. 10*c* is a side elevation view of the handrail connector shown in FIG. 10*a* with springs in an expanded state.

FIG. 10*a* shows the state of the handrail connector device 40 where the handrail ends 34 and 34' are spaced apart a normal amount (about six inches) such that the springs 100 and 100' are partially compressed such as when the mine floor 10 is level. FIG. 10*b* shows the state of the handrail connector device 40 when the handrail ends 34 and 34' are forced towards each other compressing the springs 100 and 100' such as occurs when the mine floor 10 is uneven or the handrail 20 is moved. FIG. 10*c* shows the state of the handrail connector device 40 when the handrail ends 34 and 34' are drawn apart thus allowing the springs 100 and 100' to expand such as occurs when the mine floor 10 is uneven or the handrail 20 is moved.

The installation of the handrail connection device 40 is described as follows. First, the stop 72 is fitted onto the first end 54 of the bar 42 and the tabs 80 are slid along the slots 52 until the tabs 80 rest in the groove 46. The stop 72 is rotated 90 degrees and the fastener 90 is inserted through the hole 86 and the bore 56 and is secured into the tapped hole 88. The springs 100 and 100' and the washers 102 and 102' are fitted over the respective first and second ends 54 and 54' of the bar 42. The bar 42 is then flexed or bent and the first end 54 of the bar 42 is slid into the opening 36 of the handrail end 34. The bar 42 is urged towards the handrail end 34, so as to compress the spring 100 between the handrail end 34 and the stop 72. The length "L" of the bar 42 is sized to allow the second end 54' of the bar 42 to be fitted into the opening 36 when the spring 100 is compressed. Once the spring 100 is compressed, the second end 54' of the bar 42 is inserted into the second opening 36' of the second handrail end 34'. Upon release of the second end 54', the spring 100 expands forcing the spring 100' to compress between the stop 72 and the handrail end 34', thereby centering the bar 42 between the handrail sections 30 such that both springs 100 and 100' are compressed equally between the stop 72 and the respective handrail ends 34 and 34'.

Thus, the handrail connector device of the present invention provides a flexible joint between sections of handrail which remains centered between the handrail section ends thereby protecting miners from injury and reducing the possibility of damage to the flexible joint.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention.

What is claimed is:

1. A connector for longitudinally spaced apart handrails having a pair of opposing ends each defining an opening, said connector comprising:

a flexible member having a pair of ends sized to be fitted within the opposing openings and being adapted to be retained within the handrail openings; and means for centering said flexible member between said handrails, wherein said means for centering comprises:

a stop mounted on said flexible member between said ends of said flexible member; and a pair of biasing members, each said biasing member being adapted to extend between said stop and one of said handrail ends whereby said biasing members are adapted to urge said stop to be centered between the handrail openings.

2. The connector as claimed in claim 1 wherein said stop defines an aperture through which said flexible member extends, said stop having a pair of coaxial holes and wherein said flexible member defines a bore coaxial with said pair of coaxial holes, said stop further comprising a fastener secured within said pair of coaxial holes and said bore.

3. The connector as claimed in claim 1 wherein said flexible member comprises a polyurethane bar.

4. The connector as claimed in claim 1 wherein each said biasing member comprises a spring surrounding said flexible member.

5. A connector for longitudinally spaced apart handrails having a pair of opposing ends each defining an opening, said connector comprising:

a flexible member having a pair of ends sized to be fitted within the opposing openings and being adapted to be retained within the handrail openings;

means for centering said flexible member between said handrails, wherein said means for centering comprises a stop mounted on said flexible member between said ends of said flexible member and a pair of biasing members, each said biasing member being adapted to extend between said stop and one of said handrail ends whereby said biasing members are adapted to urge said stop to be centered between the handrail openings, and wherein said stop defines an aperture through which said flexible member extends, said stop having a pair of coaxial holes and wherein said flexible member defines a bore coaxial with said pair of coaxial holes, said stop further comprising a fastener secured within said pair of coaxial holes and said bore; and a pair of washers through which said flexible member extends, each said washer being adapted to be disposed between one of said biasing members and one of the handrail ends.

6. A connector for longitudinally spaced apart handrails having a pair of opposing ends each defining an opening, said connector comprising:

a flexible member having a pair of ends sized to be fitted within the opposing openings and being adapted to be retained within the handrail openings; and means for centering said flexible member between said handrails, wherein said means for centering comprises a stop mounted on said flexible member between said ends of said flexible member and a pair of biasing members, each said biasing member being adapted to extend between said stop and one of said handrail ends whereby said biasing members are adapted to urge said stop to be centered between the handrail openings.

wherein said stop defines an aperture through which said flexible member extends, said stop having a pair of coaxial holes and wherein said flexible member defines a bore coaxial with said pair of coaxial holes, said stop further comprising a fastener secured within said pair of coaxial holes and said bore, and wherein said flexible member includes a pair of annular shoulders defining a groove and said stop includes a tab extending radially into said aperture, said tab being received within said groove.

7. The connector as claimed in claim 6 wherein said flexible member defines a slot extending from one end of said flexible member and opening into said groove, said tab being positioned between said shoulders.

8. A method of installing a handrail connector between a pair of first and second longitudinally spaced apart handrails having a pair of opposing ends each defining an opening, the method comprising the steps of:

flexing a flexible member, said flexible member having (1) a stop mounted between two ends of said flexible member and (2) first and second biasing members each disposed between each of said ends and said stop;

inserting one end of said flexible member into the opening of the first handrail;

urging said stop towards said first handrail whereby said first biasing member is compressed;

fitting the other end of said flexible member into the opening of the second handrail; and releasing said flexible member whereby said first biasing member expands and said second biasing member compresses such that said flexible member is centered between the handrail openings and each end of said flexible member is retained within a respective one of the handrail openings.

9. A sectional handrail comprising:

a plurality of longitudinally spaced apart handrail sections, each section having an end defining an opening opposing an opening in another of said handrail sections;

a flexible member having two ends, each said end fitted within one of said opposing openings and being adapted to be retained within said openings; and means for centering said flexible member between said opposing ends, wherein said means for centering comprises:

a stop mounted on said flexible member between said ends of said flexible member; and a pair of biasing members, each said biasing member extending between said stop and one of said opposing ends whereby said biasing members urge said stop to be centered between said opposing ends.

10. The sectional handrail as claimed in claim 9 wherein said stop defines an aperture through which said flexible member extends, said stop having a pair of coaxial holes, and wherein said flexible member defines a bore coaxial with said pair of coaxial holes, said stop further comprising a fastener secured within said pair of coaxial holes and said bore.

11. The sectional handrail as claimed in claim 9 wherein said flexible member comprises a polyurethane bar.

12. A sectional handrail comprising:

a plurality of longitudinally spaced apart handrail sections, each section having an end defining an opening opposing an opening in another of said handrail sections;

a flexible member having two ends, each said end fitted within one of said opposing openings and being adapted to be retained within said openings;

means for centering said flexible member between said opposing ends, wherein said means for centering comprises a stop mounted on said flexible member between said ends of said flexible member and a pair of biasing members, each said biasing member extending between said stop and one of said opposing ends whereby said biasing members urge said stop to be centered between said opposing ends; and a pair of washers through which said flexible member extends, each said washer disposed between one of said biasing members and one of said opposing ends.

13. A sectional handrail comprising:

a plurality of longitudinally spaced apart handrail sections, each section having an end defining an opening opposing an opening in another of said handrail sections;

a flexible member having two ends, each said end fitted within one of said opposing openings and being adapted to be retained within said openings; and means for centering said flexible member between said opposing ends, wherein said means for centering comprises a stop mounted on said flexible member between said ends of said flexible member and a pair of biasing members, each said biasing member extending between said stop and one of said opposing ends whereby said biasing members urge said stop to be centered between said opposing ends, and wherein said flexible member includes a pair of annular shoulders defining a groove and said stop includes a tab extending radially into said aperture, said tab being received within said groove.

14. The sectional handrail as claimed in claim 13 wherein said flexible member defines a slot extending from one end of said flexible member and opening into said groove, said tab being positioned between said shoulders.

* * * * *